US007931509B2

(12) United States Patent
Shaw et al.

(10) Patent No.: US 7,931,509 B2
(45) Date of Patent: Apr. 26, 2011

(54) COAXIAL FITTING CONTACT TUBE CONSTRUCTION

(76) Inventors: Glen David Shaw, Conway, AR (US); Robert J. Chastain, Maumelle, AR (US)

( * ) Notice: Subject to any disclaimer, the term of this patent is extended or adjusted under 35 U.S.C. 154(b) by 0 days.

(21) Appl. No.: 12/924,187

(22) Filed: Sep. 22, 2010

(65) Prior Publication Data

US 2011/0076885 A1 Mar. 31, 2011

Related U.S. Application Data

(60) Provisional application No. 61/277,364, filed on Sep. 25, 2009.

(51) Int. Cl.
*H01R 11/22* (2006.01)

(52) U.S. Cl. ..... 439/851

(58) Field of Classification Search ..... 439/654, 439/748, 842, 851
See application file for complete search history.

(56) References Cited

U.S. PATENT DOCUMENTS

| | | | | |
|---|---|---|---|---|
| 3,678,451 | A | 7/1972 | Boliver | |
| 4,447,108 | A | 5/1984 | Ghigliotti | |
| 4,550,972 | A | 11/1985 | Romak | |
| 4,657,335 | A * | 4/1987 | Koch et al. | 439/851 |
| 4,750,897 | A | 6/1988 | Neidecker | |
| 4,840,587 | A | 6/1989 | Lancella | |
| 4,840,588 | A | 6/1989 | Lancella | |
| 5,326,289 | A * | 7/1994 | Leisey | 439/851 |
| 5,667,409 | A | 9/1997 | Wong | |
| 5,863,226 | A | 1/1999 | Lan | |
| 5,921,822 | A * | 7/1999 | Kennedy et al. | 439/851 |
| 6,065,997 | A | 5/2000 | Wang | |
| 6,113,431 | A | 9/2000 | Wong | |
| 6,186,841 | B1 | 2/2001 | Jacobsson | |
| 6,358,104 | B2 * | 3/2002 | Daugherty et al. | 439/851 |
| 6,471,555 | B2 * | 10/2002 | Creze | 439/843 |
| 6,808,426 | B2 | 10/2004 | Liu | |
| 6,899,563 | B1 | 5/2005 | Lee | |
| 7,121,881 | B2 | 10/2006 | Jones | |
| 7,252,560 | B2 | 8/2007 | Wendland | |
| 7,331,821 | B2 | 2/2008 | Feldman | |
| 7,387,548 | B2 | 6/2008 | Takehara | |
| 7,442,080 | B1 * | 10/2008 | Tsen | 439/578 |

* cited by examiner

*Primary Examiner* — Tho D Ta
(74) *Attorney, Agent, or Firm* — Stephen D. Carver

(57) ABSTRACT

Contact tubes and coaxial cable fittings with the tubes, including barrel connectors, right angle connectors, and sockets. The elongated, tubular contact tube extends coaxially within each fitting, establishing at least one female juncture for receiving the center conductor projecting from a coaxial connector. The insulators and bushings center and retain the contact tube within the connectors. The contact tubes are rolled from beryllium, copper alloy sheets having slotted portions defined on one or both sheet ends. The slotted portions comprise a plurality of parallel, curved, slots, each of which borders curved metal strips. Half slots at the bottom and top of the slotted portions adjoin each other after rolling to form an additional slot. Because of the shape of the slots and strips a generally pentagonal configuration is assumed after rolling and contraction of the slotted region, such that contact points overlap.

20 Claims, 8 Drawing Sheets

COAXIAL FITTING CONTACT TUBE CONSTRUCTION

CROSS-REFERENCE TO RELATED APPLICATIONS

This utility patent application discloses and claims subject matter disclosed in an earlier-filed, pending U.S. Provisional Application Ser. No. 61/277,364, Filed Sep. 25, 2009, entitled "Contact Tube Construction for Coaxial Fittings," by inventors Glen David Shaw and Robert J. Chastain, and priority is claimed.

BACKGROUND OF THE INVENTION

1. Field of the Invention

The present invention relates generally to coaxial cable connectors, couplings and fittings such as barrel connectors. More particularly, the present invention relates to an improved conductive, contact tube construction for barrel connectors and similar devices that facilitates an extremely dependable, wide-band connection. Known prior art is classified in United States Patent Class 439, Subclasses 406, 578, 654, 852, and 856.

2. Description of the Related Art

Popular cable television systems and satellite television receiving systems depend upon coaxial cable for distributing signals. As is known in the satellite TV arts, coaxial cable in such installations is terminated by F-connectors that threadably establish the necessary signal wiring connections. The ubiquitous F-connector forms a "male" connection portion that fits to a variety of threaded receptacles, forming the "female" portion of the connection. Barrel connectors, for example, have a pair of female terminal ports, one on each end, and they join two F-connector-borne cables together.

F-connectors have numerous advantages over other known fittings, such as RCA, BNC, SMA, and PL-259 connectors, in that no soldering is needed for installation, and costs are reduced as parts are minimized. For example, with an F-connector, the center conductor of a properly prepared coaxial cable fitted to it forms the "male" portion of the receptacle connection, and no separate part is needed. A wide variety of F-connectors are known in the art, including the popular compression type connector that aids in rapid assembly and installation. Hundreds of such connectors are seen in U.S. Patent Class 439, particularly Subclass 578.

However, the extremely high bandwidths and frequencies distributed in conjunction with modern satellite installations necessitates a variety of strict quality control factors. For example, the electrical connection established by the F-connector must not add electrical resistance to the circuit. It must exhibit a proper surge impedance to maintain a wide bandwidth, in the order of several Gigahertz. Numerous physical design requirements exist as well. For example, connectors must maintain a proper seal against the environment, and they must function over long time periods through extreme weather and temperature conditions. Requirements exist governing frictional insertion and disconnection or withdrawal forces as well. Importantly, since a variety of coaxial cable diameters exist, it is imperative that satisfactory F-connectors function with differently sized cables, such as RG-6 and RG-59 coaxial cables that are most popular in the satellite television art.

The foregoing F-connector considerations relate directly to the structure of the "female" sockets or receptacles to which the F-connectors are fitted. The "female" half of the junction must compliment the F-connector design imperatives. High bandwidth must be maintained through the junction, and reliable and effective impedance control is necessary. The socket, for example, must not exhibit an impedance discontinuity that can effect bandwidth.

Common receptive sockets to which F-connectors are fitted typically include some form of coaxial tube disposed concentrically within the fitting proximate to and concentric with the threaded input socket. The innermost conductor of the coaxial cable (i.e., that forms the "male" end of the connection that projects outwardly from the front of the F-connector) is electrically coupled to the tube when the F-connector is installed. A proper electrical contact must be formed at the latter juncture, internally of the mated connector elements. A variety of design constructions have been proposed for insuring such a connection.

For example, U.S. Pat. No. 4,128,293 issued Dec. 5, 1978 provides enhanced connections with an elongated metallic band having a plurality of substantially parallel fingers. One end of each finger is attached to and integral with the band. The fingers provide a large surface area for electrical contact.

U.S. Pat. No. 4,447,108 issued May 8, 1984 discloses an improved socket for electrical connectors defined by twisting of a cylindrical inner sleeve. Slots arranged on the cylindrical surface of the sleeve are inclined with respect to the longitudinal sleeve axis. The shape of the slots contributes to correct sleeve deformation in response to twisting.

U.S. Pat. No. 4,550,972 issued Nov. 5, 1985 discloses a formed contact socket with circumferentially continuous rings at pin receiving ends for enhancing electrical contact. An intermediate portion of the socket comprises beams which have ends integral with the rings. Inwardly formed spherical bosses are provided on the rings which engage a pin upon movement of the pin into the socket. The bosses are spaced along the axis of the socket and are encountered sequentially during axial movements of the pin into or out of the receptive socket.

U.S. Pat. No. 4,750,897 issued Jun. 14, 1988 discloses a contact apparatus with at least one segmented body formed by bars separated from each other by slots and having a curved central area. The bars have the form of a three-dimensional curve. In their end areas, the bars possess a section curved in the opposite sense to said curved central area.

U.S. Pat. No. 4,840,587 issued Jun. 20, 1989 discloses a female contact that receives a pin contact from an F-connector. Areas establishing electrical contact with the pin contact upon insertion are arranged at least approximately according to a family of straight generatrices of a hyperboloid of revolution of one branch. The composite female contact comprises a proper elastic contact element consisting of a cylindrical sleeve provided with through slots on its surface and inclined with respect to the longitudinal axis of the sleeve, which is deformed by twisting according to a predetermined angle and directed in the sense of inclination of the slots.

U.S. Pat. No. 5,667,409 issued Sep. 16, 1997 discloses a barrel connector for use with F-connectors that includes a pair of opposite "female" ends. A tubular, center conductor tube includes plural, inwardly punched contact points defined on the tube ends. The contacts firmly abut the central wire of coaxial cable terminating in an F-connector. The tube is constrained within a larger diameter housing with spaced sleeves. The material of the holes is punched inwardly, but is not removed from the tube. The contact component thus formed comprises a pair of inclined planes extending towards the interior of each end of the tube.

U.S. Pat. No. 5,863,226 issued Jan. 26, 1999 discloses a connector for coaxial cable including a tubular contact fitted between two insulating sleeves. The contact member is made from sheet material by curling. Ends of the contact member are not joined together, and a narrow slit is defined between them. When a wire core with a diameter of between 1.2 to 1.3 mm, i.e., as with an F-type coaxial connector, is inserted into the contact member, the contact member is stretched open to achieve greater resilience.

U.S. Pat. No. 6,113,431 issued Sep. 5, 2000 provides an F-port coaxial barrel connector. The connector body comprises threads on its opposite ends for receiving F-connectors, with a central hexagonal mounting nut. Fitted inside the containment hole is a first insulator sleeve and a second insulator sleeve, and clipped in between the first and second insulator sleeves is a tubular contact component. Lathe fabrication allows for a smooth and even finish on all flat surfaces and enables the assembly of the first insulator sleeve, the second insulator sleeve, and tubular contact component to be conveniently inserted into the containment hole, while preventing dislodging.

U.S. Pat. No. 6,065,997 issued May 23, 2000 discloses an analogous connector device for use with cable and satellite television installations, including an integrally formed housing, a contact member and an insulating tube fitted in an inner, through-hole of the housing. An annular groove is formed on an inner edge of one end of the housing and an engaging flange is formed at the other end of the housing. The insulating tube is disposed within the annular flange. The contact member is placed in the insulating tube which is fitted into the housing with the annular flange engaged with the annular groove.

U.S. Pat. No. 6,808,426 issued Oct. 26, 2004 also discloses a barrel connector for use with popular F-connectors. A conductive contact tube that is coaxially constrained within the connector by special end sleeves includes inwardly bent, clamping tabs for establishing electrical contract by grasping the coaxial cable center conductor when an F-connector is threadably fitted to the barrel connector.

U.S. Pat. No. 6,899,563 issued May 31, 2005 provides a coaxial cable connector with an internal transmission tube comprising four elastic strips at each of its two ends. The four elastic strips are disposed in the transmission tube in a bent manner, and each elastic strip is formed with a projecting plane and inclined planes. Side edges of the four elastic strips are joined to form a clamping end for inserting and connecting with a coaxial cable therein.

U.S. Pat. No. 7,252,560 issued Aug. 7, 2007 discloses a center conductor for use in a coaxial jack module.

Numerous other patents relating to electrical construction contact techniques exist, such as U.S. Pat. Nos. 3,317,887, 3,381,261, 3,678,451, 3,815,081, 3,861,776, 4,002,400, 4,298,242, 4,550,972, 6,186,841, 7,121,881, 7,387,548, and 7,442,080.

BRIEF SUMMARY OF THE INVENTION

This invention provides an improved contact tube construction for coaxial fittings of the type fitted to various electrical connectors, such as BNC, SMA, RCA, PL-259, and F-connectors. Ideally it is adapted for use with popular F-connectors used in the satellite and cable TV industry. The contact tube construction can be employed with barrel connectors, right angled connectors, single-connection sockets, and the like.

The preferred contact tube construction is utilized in conjunction with a variety of coaxial cable fittings, preferably F-type, including barrel connectors, right angle connectors, and various forms of receptive sockets. The elongated, generally tubular contact tube extends coaxially within each fitting, establishing at least one female juncture for receiving the center conductor projecting from a coaxial F-connector. Suitable insulators center and retain the contact tube within the connectors.

The preferred contact tube is rolled from a copper beryllium alloy sheet of metal. Slotted portions of the sheet are defined on one or both sheet ends. The slotted portions comprise a plurality of parallel, curved, slots, each of which borders curved metal strips. Preferably there are five strips. Half slots at the bottom and top of the slotted portions adjoin each other after rolling to form an additional slot.

Each slot is arched, and each bordering strip is arched. During rolling, compression of the tube radially contracts the strips and slotted portions and a generally polygonal (i.e., preferably pentagonal) overlapping configuration is assumed (i.e., in vertical section). Radially spaced-apart peripheral edges of each strip radially abut two bordering strips to form a regular polygonal enclosure whose sides abut the center conductor of coaxial cables of various sizes.

Thus a basic object of our invention is to provide an improved center connector construction for a variety of coaxial cable fittings that are mated to electrical connectors, particularly F-type connectors, that interconnect coaxial cable.

A related object is to provide a connector construction that exhibits proper impedance over and extremely wide frequency band sufficient for use in modern cable television and satellite television installations.

Another fundamental object of our invention to provide a contact tube construction for a variety of coaxial fittings, sockets and connectors, particularly those mated to F-connectors, that can accommodate different sizes of coaxial cable while maintaining an extremely high bandwidth.

Another important object is to minimize resistive losses and/or DC losses in a coaxial cable junction.

Further, it is an object to maximize the skin effect in devices of this nature.

It is also an object of our invention to provide a contact tube construction for cable connectors, coupling and fittings that establishes multiple, resilient, radially spaced-apart contact points between the tube and central wire of the coaxial cable.

Another basic object is to provide a construction of the character described that accommodates different cable diameters and maintains proper electrical transmission characteristics.

A still further object is to provide a contact tube construction capable of deployment in barrel connectors, right angled connectors, sockets and the like.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
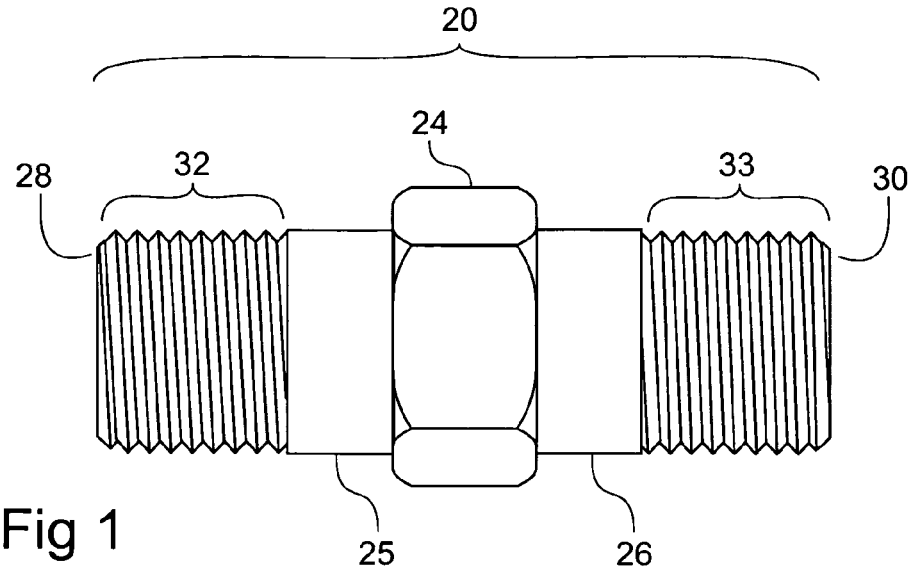
FIG. 1 is an elevational view of a coaxial barrel connector with the instant contact tube construction disposed therewithin.
Figure 2:
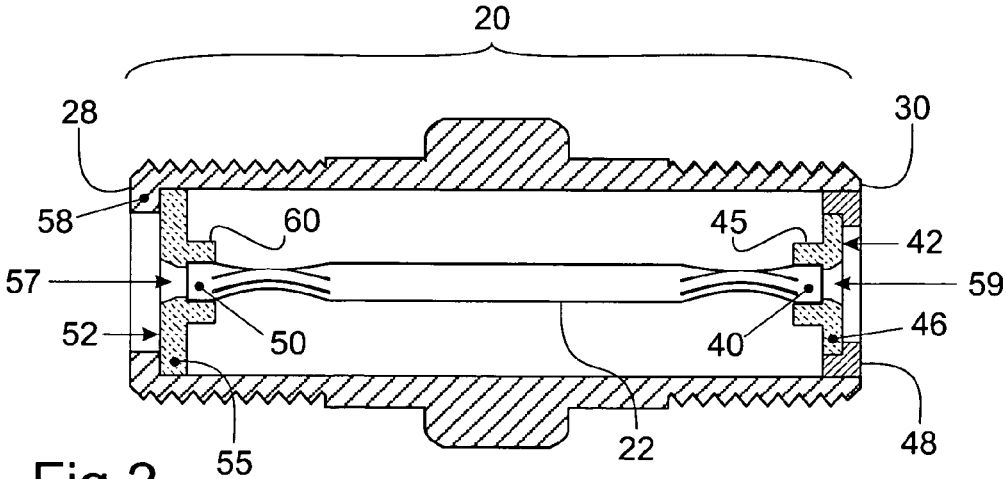
FIG. 2 is a longitudinal sectional view of the barrel connector of FIG. 1, showing internal details.

With initial reference directed to FIGS. 1 and 2 of the appended drawings, a barrel connector constructed generally in accordance with the best mode of the invention has been generally designated by the reference numeral 20. The preferred contact tube (FIGS. 2, 7) has been designated by the reference numeral 22, and an alternative contact tube for a barrel connector (i.e., FIGS. 8-12) has been designated with the reference numeral 23. The contact tubes of this invention are preferably constructed from beryllium-copper alloy.

The metallic body of the barrel connector, visible from the exterior (i.e., FIG. 1) is conventional. A center hex nut 24 is integrally bounded by tubular shank portions 25, 26. The spaced-apart left and right ends 28, 30 respectively are provided with conventional external threads 32, 33 that threadably connect to the head of a typical coaxial connector. Preferably, the depicted barrel connector 20 is employed with F-connectors, but the teachings of the invention may be adapted to RCA, SMA, PL-259, BNC, and other common electrical connectors that interconnect with various types of conventional coaxial cable.

Figure 7:
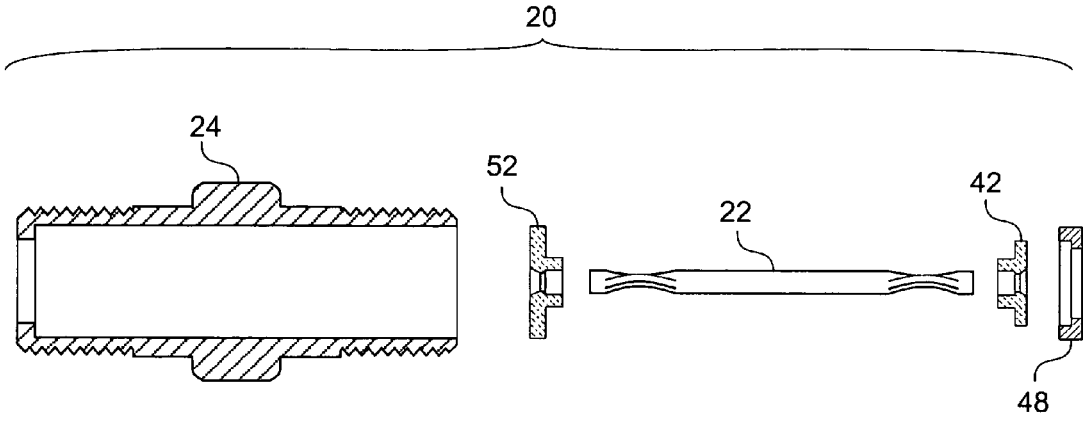
FIG. 7 is an exploded isometric view of the barrel connector of FIGS. 1 and 2 showing the contact tube details.
Figure 8:
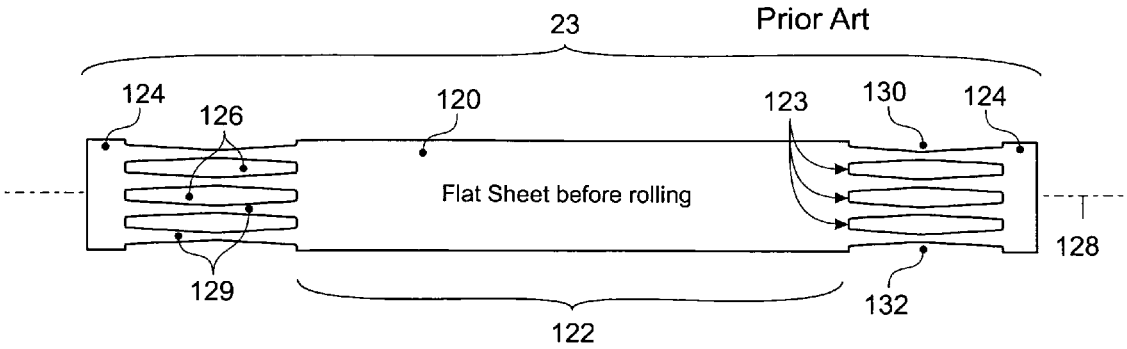
FIG. 8 is a plan view of a typical prior art sheet rolled into a prior art contact tube.
Figure 9:
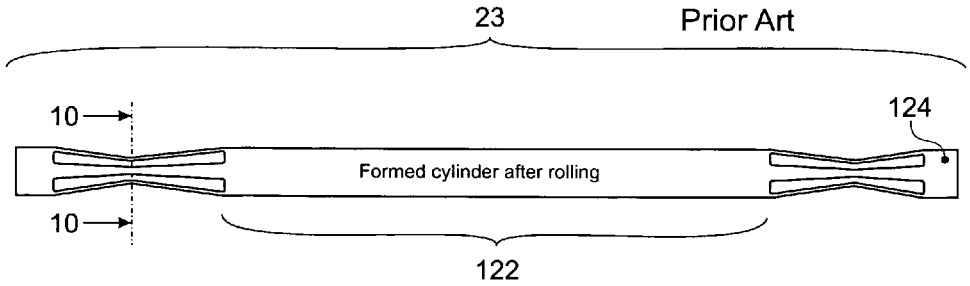
FIG. 9 is a plan view of a prior are contact tube.

Viewing FIGS. 2 and 7, the contact tube 22, which will be detailed hereinafter, extends coaxially within the barrel connector 20, between left and right ends 28 and 30 respectively. Right end 40 of the contact tube 22 may be received within a suitable, generally circular insulator 42 (i.e., at the right of FIG. 2) fitted within the right end 30 of the barrel connector 20. A flange portion 46 of the insulator 42 is retained with the circular shoulder-recess of an offset metallic bushing 48 that has a generally L-shaped cross section. A reduced diameter stem portion 45 of the insulator 42, that is integral with the flange portion 46, coaxially receives contact tube end 40 that abuts an internal shoulder.

At the left of FIG. 2 a slightly different construction, that enables assembly, is shown. Left end 50 of the contact tube 22 is coaxially retained within insulator 52, that comprises a flange portion 55 coaxially retained within the barrel connector 20 by an internal shoulder 58. Shoulder 58 has a generally L-shaped cross section. A reduced diameter stem portion 60 of the insulator 52, that is integral with the flange portion 55, coaxially receives the left end 50 of the contact tube, anchoring within an internal shoulder. As can be seen in FIG. 2, there are similarly dimensioned tubular access passageways 57, 59 formed at ends of the barrel connector that are coaxial with tubular stems 60 and 45 and which admit wire protruding from the F-connector (or the male end of a PL259 connector or BNC or RCA connector) into the contact tube ends to establish an electrical connection.

Figure 3:
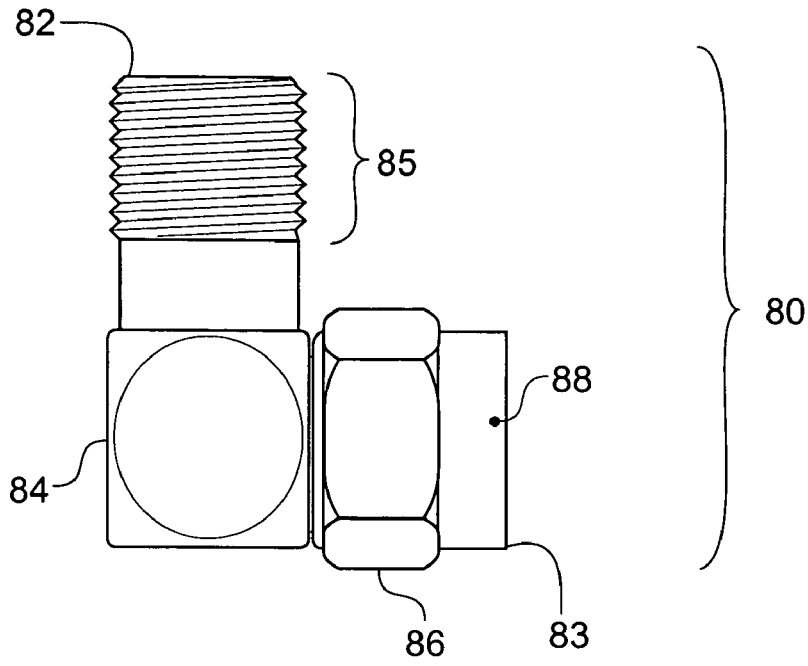
FIG. 3 is an elevational view of a right angle coaxial connector with the preferred contact tube construction.
Figure 4:
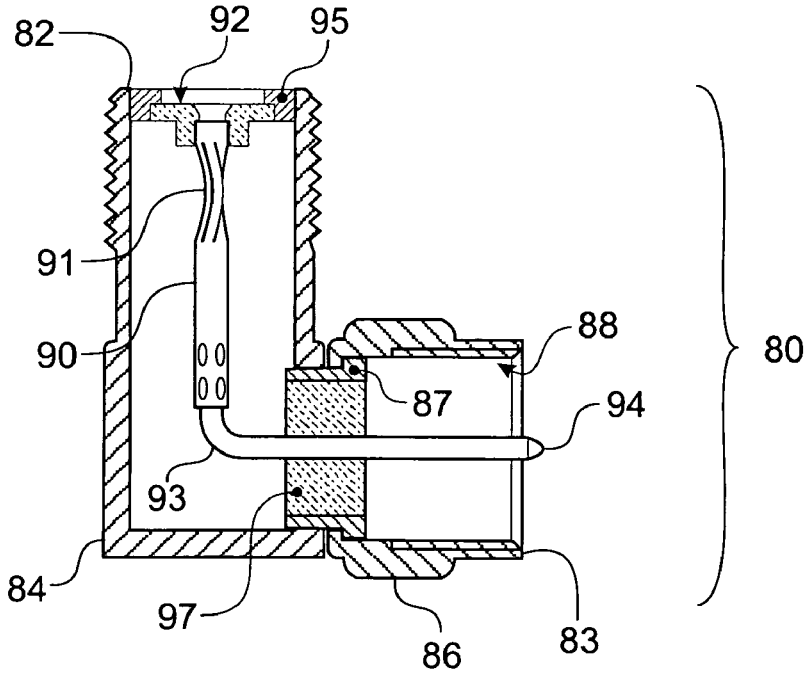
FIG. 4 is a sectional view of the right angle connector of FIG. 3.

FIG. 3 illustrates a right angled connector 80 whose exterior appearance is conventional. Connector 80 comprises opposed, angled-apart ends 82 and 83 that project from a generally cubicle union portion 84. Female end 82 comprises conventional exterior threads 85. The male end 83 comprises a rotatable hex head 86 that is rotatably secured by a metal, internal bushing 87 (FIG. 4). Plastic bushing 97 coaxially secured to bushing 87 secures and aligns the contact tube structure. An internally threaded sleeve 88 projects from head 86 to mate with a suitably threaded connector end. A shortened contact tube 90 with a contact region 91 (FIG. 4) designed in accordance with the invention extends within connector end 82 between a suitable insulator 92 and an angled junction pin 93 whose lower angled end 94 forms the "male" conductor of the male end 83. Bushing 87 restrains and aligns pin 93. Metallic bushing 95 seats insulator 92 (FIG. 3).

Figure 5:
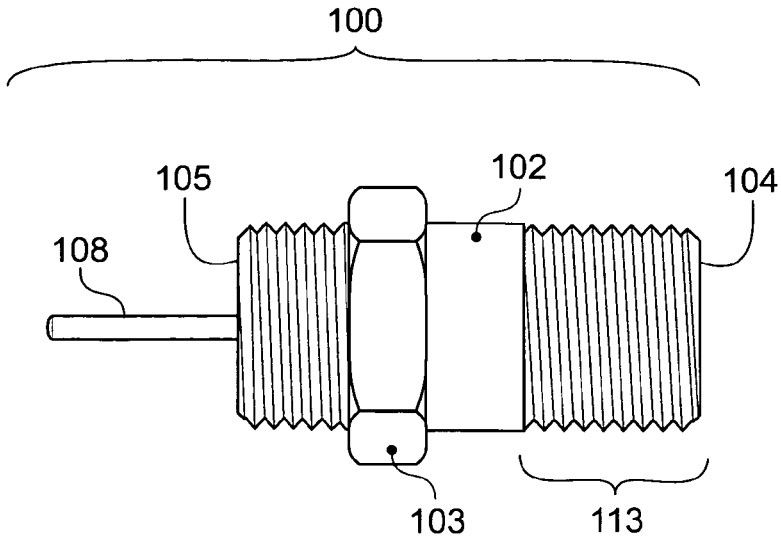
FIG. 5 is an elevational view of a single ended coaxial connector socket with the preferred contact tube construction.
Figure 6:
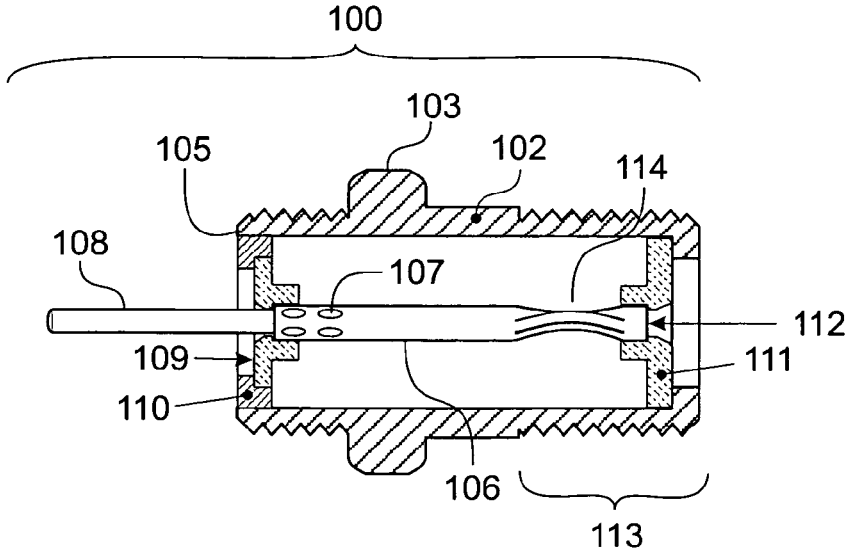
FIG. 6 is a longitudinal sectional view of the socket of FIG. 5.

A single ended F-connector socket 100 is illustrated in FIGS. 5 and 6. A tubular body segment 102 integrally coaxially extends from hex-nut portion 103. Female end 104 is externally threaded conventionally. The opposite threaded end 105 may be fastened within an electronic component such as a circuit board or chassis with a suitable nut. Alternatively, threaded end 105 may be mated to a threaded socket. The contact tube 106 has a left end 107 crimped to a conductor 108. Insulator 109, which is similar to insulator 42 (FIG. 2) described previously, centers and restrains both pin 106 and conductor 108. Conductor 108 forms a solder pin to which various components may be soldered. Insulator 109 is centered within metallic bushing 110. A spaced-apart right bushing 111 (FIG. 6), similar to insulator 52 (FIG. 2), terminates against an inner shoulder of the socket body. Threads 113 enable connection to a coaxial connector, preferably an F-connector, whose center wire projection is inserted and grasped within the contact tube right end through orifice 112. The contact region 114 (FIG. 6) is constructed in accordance with the invention as hereinafter detailed.

Turning to FIGS. 8-12, prior art contact tube 23 is rolled from a generally rectangular, flat planar sheet 120 of phosphor-bronze alloy. A central, generally rectangular midsection 122 is bounded on each end with integral slotted portions 123, that integrally terminate in integral, solid end portions 124. The longitudinal axis is designated by the reference numeral 128. The slotted portions 123 comprise three parallel, elongated slots 126, each bounded on its upper and lower edges by solid metal material forming spaced apart, generally planar conductive strips 129. The opposite ends of each slot are reduced in width from the larger slot middle, so that metal strips 129 have their narrowest extent proximate the center of slots 126. Half slots 130 and 132 appear at the top and bottom of the slotted portions 123 on unfolded flat sheet 120. After rolling of sheet 120, half-slots 130, 132 align to form another slot similar to and generally parallel with slots 126.

Figure 10:
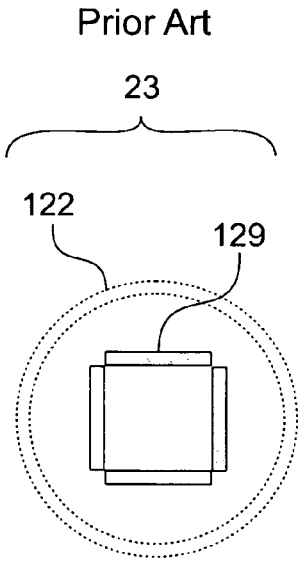
FIG. 10 is an enlarged sectional view of a prior art contact tube taken generally along line 10-10 of FIG. 9.
Figure 11:
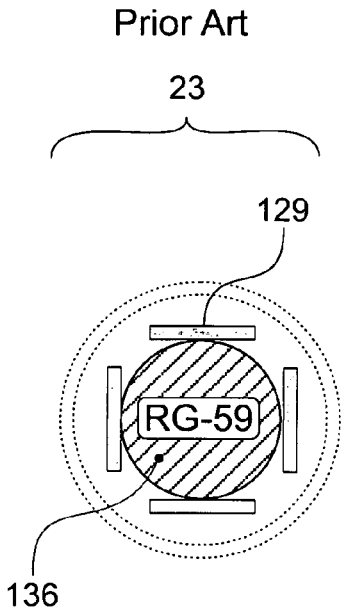
FIGS. 11 and 12 are sectional views showing how the prior art contact tube of FIGS. 8-9 mates with an F-connector center conductor provided by RG-59 and RG-6 coaxial cable respectively.
Figure 12:
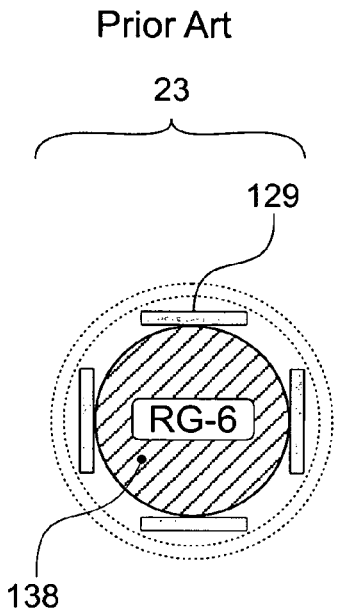

After rolling (i.e., FIG. 9), midsection 122 and end portions 124 assume a tubular configuration, with a round cross section. Similarly, the slotted portions are disposed in a tubular arrangement, with spaced apart strips 129 spaced apart the circumference of the tube 23, separated at equidistant intervals by the slots 126, and the slot resulting from parallel radial alignment of half-slots 130 and 132. The center of the slotted regions at section line 10-10 (FIG. 9) is bent inwardly and radially compressed. The four strips 129 assume a generally square configuration at cross-section 10-10 (FIG. 10). As seen in FIG. 11, when the center conductor 136 of RG-59 coaxial cable, for example, projecting from an attached F-connector, penetrates tube 122 through ends 124 (FIG. 9), the four strips 129 tightly engage the wire end at ninety degree intervals, tangentially bearing against the circular outer profile of conductor 136. When larger diameter coaxial cable is used, such as type RG-6, the strips 129 (FIG. 12) are deflected outwardly slightly to the position illustrated in FIG. 12, while firmly bearing against the outer circular wire periphery to insure electrical contact with conductor 138.

The prior art design of FIGS. 8-12 has no overlapping. A comparison of FIGS. 10-12 with the corresponding sectional views of the improved contact tube seen in FIGS. 15-17 reveals this.

Figure 13:
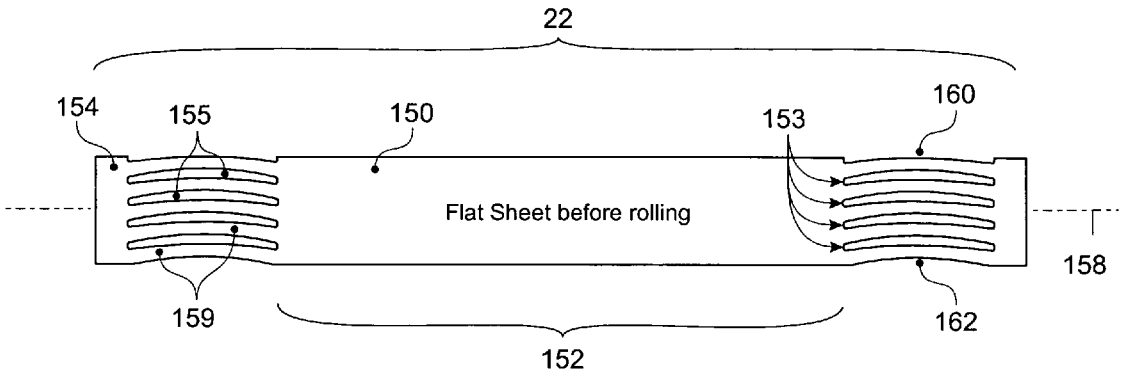
FIG. 13 is a plan view of our improved contact tube, showing the flat constituent sheet before rolling.
Figure 14:
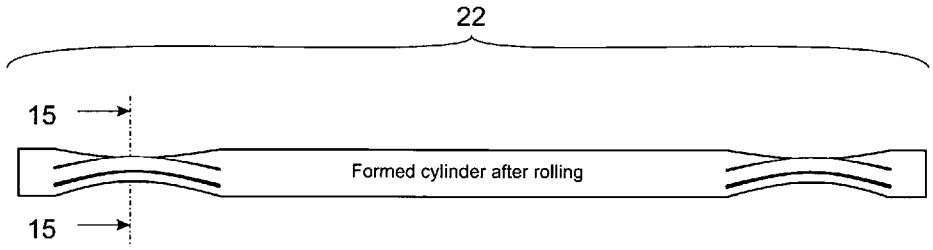
FIG. 14 is a plan view of the our improved contact tube, showing it after rolling.

Referencing FIGS. 13 and 14, the preferred contact tube 22 is rolled from a generally rectangular, flat planar sheet 150. In the best mode the sheet is beryllium copper alloy. A central, generally rectangular midsection 152 is bounded on each end with integral slotted portions 153 that terminate in integral solid end portions 154. The longitudinal axis is designated by the reference numeral 158. The slotted portions 153 comprise four parallel, curved, slots 155, each bounded on its upper and lower edges by solid metal material forming five, spaced apart, generally planar conductive strips 159. Again, opposite ends of each slot are reduced in width from the larger slot middle, and boundary strips 159 are narrowest proximate the center of slotted portions 153. Half slots 160 and 162 appear at the bottom and top of the slotted portions 153 on sheet 150, and after rolling they align to form another slot similar in size, shape and configuration to slots 155.

Importantly, each slot 155, and each bordering strip 159, is arched. As viewed in FIG. 13, the centers of each slot 155, and the centers of each bordering strip 159, are thus arched relative to their opposite ends. The center slot and strip portions are thus advanced in position radially from their ends after rolling, as apparent in FIG. 15, derived along section line 15-15 from FIG. 14. During rolling, a slight compression to the tube contracts the slotted portions 153, and given the curved shape of the slots and strips seen in FIG. 13, the five strips 159 assume a generally pentagonal configuration (FIGS. 15-17), wherein peripheral edges of each strip 159 radially abut two bordering adjacent strips. In other words, the radially inwardly bent strips 159 resiliently form a regular polygonal enclosure (i.e., FIG. 15) whose sides are equal in number to the number of strips 159 involved. The diameter of the region traversed by section line 15-15 (FIG. 14) is thus reduced from the diameter of region 152.

Figure 15:
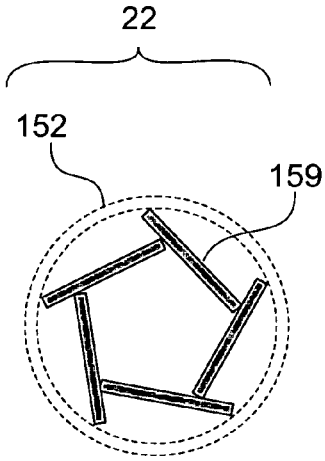
FIG. 15 is an enlarged sectional view taken generally along line 15-15 of FIG. 14; and, FIGS. 16 and 17 are sectional views showing how the preferred contact tube mates with an F-connector center conductor provided by RG-59 and RG-6 coaxial cable respectively.
Figure 16:
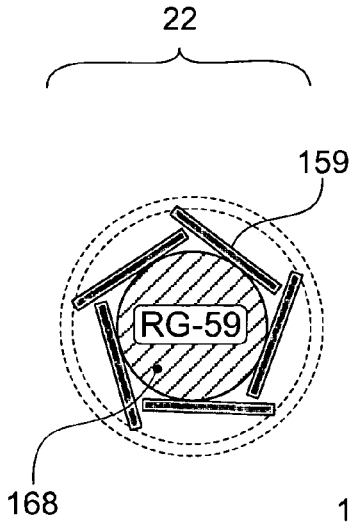
Figure 17:
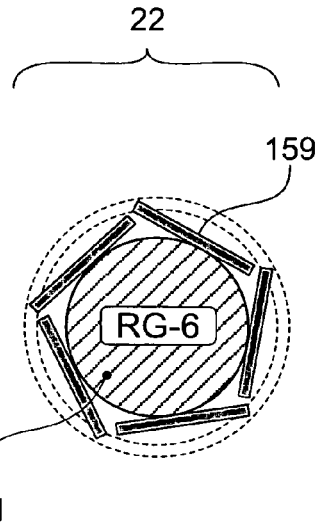

As seen in FIG. 16, when an end of RG-59 coaxial cable projecting from an attached F-connector penetrates the contact tube 22, the five strips 159 are deflected slightly, but maintain the polygonal alignment. They tightly engage the wire end 168 at seventy-two degree intervals, abutting the periphery of the circular wire 168. As seen in FIG. 15, with smaller coaxial cable the edges of the strips 159 may slightly abut one another. With larger diameter, type RG-6 coaxial cable, the strips 159 (FIG. 17) are deflected more, appearing as illustrated in FIG. 17, while firmly bearing against the wire periphery to insure electrical contact. However the edges do not abut one another in FIG. 17; abutment depends on the relative size of the RG-6 coaxial cable center conductor 161.

From the foregoing, it will be seen that this invention is one well adapted to obtain all the ends and objects herein set forth, together with other inherent advantages.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A contact tube for coaxial cable fittings comprising at least one female fitting end, the tube comprising:

a longitudinal axis;

a generally rectangular metallic sheet adapted to be rolled into tubular form, each sheet comprising a generally planar midsection, at least one generally planar, integral end portion, and at least one integral slotted portion disposed between an end portion and said midsection;

each slotted portion comprising a plurality of parallel, curved, slots, radially separated from one another by curved metal strips;

wherein after rolling the midsection and end portions assume a tubular configuration of a first diameter, and the slotted portions form a tubular configuration with a second diameter smaller than said first diameter, with radially spaced apart strips separated at equidistant radial intervals by slots; and, wherein said strips are bent inwardly towards said longitudinal axis to form radially spaced apart contact points disposed in a generally polygonal configuration, the strips contacting the periphery of an inner conductor from a male fitting electrically connect therewith and overlapping one another.

2. The contact tube as defined in claim 1 further comprising half slots associated with each slotted end portion adapted to form a full slot after rolling of said sheet.

3. The contact tube as defined in claim 1 wherein the sheet comprises beryllium copper alloy.

4. The contact tube as defined in claim 1 wherein the radially spaced apart contact points assume a generally pentagonal configuration.

5. The contact tube as defined in claim 1 wherein the radially spaced apart contact points assume a generally overlapping configuration adapted to connect with standard coaxial cables and larger diameter coaxial cable.

6. A barrel connector adapted to be connected with a pair of coaxial cable fittings, the barrel connector comprising:

an elongated tubular body having an interior and a pair of opposite, spaced-part threaded ends adapted to threadably receive a coaxial connector;

a contact tube extending coaxially within said barrel connector body between said ends;

means for centering and securing the contact tube within said barrel connector; and, wherein the contact tube comprises:

a longitudinal axis;

a generally rectangular metallic sheet adapted to be rolled into a tube, each sheet comprising a generally planar midsection, at least one generally planar, integral end portion, and at least one integral slotted portion disposed between an end portion and said midsection;

each slotted portion comprising a plurality of generally parallel, curved, slots, radially separated from one another by curved metal strips;

wherein after rolling the midsection and end portions assume a tubular configuration of a first diameter, and the slotted portions form a tubular configuration with a second diameter smaller than said first diameter, with radially spaced apart strips separated at equidistant radial intervals by slots; and, wherein said strips are bent inwardly towards said longitudinal axis to form radially spaced apart contact points disposed in a generally polygonal configuration, the strips overlapping and contacting the periphery of an inner conductor from a male fitting electrically connect therewith.

7. The barrel connector as defined in claim 6 wherein the contact tube further comprises half slots associated with each slotted end portion adapted to form a full slot after rolling of said sheet.

8. The barrel connector as defined in claim 7 wherein the contact tube sheet comprises beryllium copper alloy.

9. The barrel connector as defined in claim 7 wherein the radially spaced apart contact points assume a generally pentagonal configuration.

10. The barrel connector as defined in claim 9 wherein the radially spaced apart contact points assume a generally pentagonal configuration adapted to connect with standard coaxial cables and larger diameter coaxial cable.

11. A right angled connector adapted to be connected to a coaxial cable fitting, the right angled connector comprising:

a tubular, right angled body having an interior and at least one threaded end adapted to threadably receive a coaxial connector;

a contact tube extending coaxially within said barrel connector body from said end;

means for centering and securing the contact tube within said right angled connector; and, wherein the contact tube comprises:

a longitudinal axis;

a generally rectangular metallic sheet adapted to be rolled into tubular form, each sheet comprising a generally planar midsection, at least one generally planar, integral end portion, and at least one integral slotted portion disposed between an end portion and said midsection;

each slotted portion comprising a plurality of parallel, curved, slots, radially separated from one another by curved metal strips;

wherein after rolling the midsection and end portions assume a tubular configuration of a first diameter, and the slotted portions form a tubular configuration with a second diameter smaller than said first diameter, with radially spaced apart strips separated at equidistant radial intervals by slots; and, wherein said strips are bent inwardly towards said longitudinal axis to form radially spaced apart contact points disposed in a generally polygonal configuration, the strips overlapping and contacting the periphery of an inner conductor from a male fitting electrically connect therewith.

12. The right angled connector as defined in claim 11 wherein the contact tube further comprises half slots associated with each slotted end portion adapted to form a full slot after rolling of said sheet.

13. The right angled connector as defined in claim 11 wherein the contact tube sheet comprises beryllium copper alloy.

14. The right angled connector as defined in claim 13 wherein the radially spaced apart contact points assume a generally square configuration.

15. The right angled connector as defined in claim 13 wherein the radially spaced apart contact points assume a generally pentagonal configuration adapted to connect with standard coaxial cables and larger diameter coaxial cable.

16. A singled ended socket adapted to be connected to a coaxial cable fitting, the socket comprising:

a tubular, right angled body having an interior and at least one threaded end adapted to threadably receive a coaxial connector;

a contact tube extending coaxially within said barrel connector body from said end;

means for centering and securing the contact tube within said right angled connector; and, wherein the contact tube comprises:

a longitudinal axis;

a generally rectangular metallic sheet rolled adapted to be rolled into tubular form, each sheet comprising a generally planar midsection, at least one generally planar, integral end portion, and at least one integral slotted portion disposed between an end portion and said midsection;

each slotted portion comprising a plurality of parallel, curved, slots, radially separated from one another by curved metal strips;

wherein after rolling the midsection and end portions assume a tubular configuration of a first diameter, and the slotted portions form a tubular configuration with a second diameter smaller than said first diameter, with radially spaced apart strips separated at equidistant radial intervals by slots; and, wherein said strips are bent inwardly towards said longitudinal axis to form radially spaced apart contact points disposed in a generally polygonal configuration, the strips overlapping and contacting the periphery of an inner conductor from a male fitting electrically connect therewith.

17. The socket as defined in claim 16 wherein the contact tube further comprises half slots associated with each slotted end portion adapted to form a full slot after rolling of said sheet.

18. The socket as defined in claim 16 wherein the contact tube sheet comprises beryllium copper alloy.

19. The socket as defined in claim 16 wherein the radially spaced apart contact points assume a generally square configuration.

20. The socket as defined in claim 16 wherein the radially spaced apart contact points assume a generally pentagonal configuration adapted to connect with standard coaxial cables and larger diameter coaxial cable.

* * * * *